US006494068B2

(12) United States Patent
Lee

(10) Patent No.: US 6,494,068 B2
(45) Date of Patent: Dec. 17, 2002

(54) LOCK CORE ASSEMBLY

(75) Inventor: Chun-Chang Lee, Thaishan (TW)

(73) Assignee: Tung Chu International Inc., Taipei (TW)

( * ) Notice: Subject to any disclaimer, the term of this patent is extended or adjusted under 35 U.S.C. 154(b) by 0 days.

(21) Appl. No.: 09/793,549

(22) Filed: Feb. 27, 2001

(65) Prior Publication Data

US 2002/0116967 A1 Aug. 29, 2002

(51) Int. Cl.[7] ..... E05B 29/04

(52) U.S. Cl. ..... 70/366; 70/409; 70/491; 70/496

(58) Field of Search ..... 70/491, 495, 496, 70/377, 392, 385, 365, 366, 387

(56) References Cited

U.S. PATENT DOCUMENTS

| | | | | | |
|---|---|---|---|---|---|
| 89,197 | A | * | 4/1869 | Esettell | 70/491 |
| 1,004,904 | A | * | 10/1911 | Rees | 70/385 |
| 1,720,838 | A | * | 7/1929 | De Castro É Iznaga | 70/491 |
| 1,819,853 | A | * | 8/1931 | Von Mehreu | 70/385 |
| 2,390,471 | A | * | 12/1945 | Suter | 70/385 |
| 2,453,066 | A | * | 11/1948 | Gabrielsen | 70/385 |
| 3,326,024 | A | * | 6/1967 | Dreyfus et al. | 70/351 |
| 3,408,840 | A | * | 11/1968 | Hasenbein | 70/375 |
| 3,492,842 | A | * | 2/1970 | Schlage | 70/385 |
| 3,524,335 | A | * | 8/1970 | George | 70/491 |
| 4,062,211 | A | * | 12/1977 | Miller et al. | 70/366 |
| 4,077,240 | A | * | 3/1978 | Crusnianski | 70/360 |
| 4,083,212 | A | * | 4/1978 | Proefrock | 70/417 X |
| 4,359,886 | A | * | 11/1982 | Evans et al. | 70/366 |
| 4,418,555 | A | * | 12/1983 | Uyeda | 70/324 X |
| 4,631,942 | A | * | 12/1986 | Sierra | 70/368 |
| 5,335,520 | A | * | 8/1994 | Lee | 70/377 X |
| 5,979,200 | A | * | 11/1999 | Cliff | 70/368 X |
| 6,003,351 | A | * | 12/1999 | Chao et al. | 70/375 X |

FOREIGN PATENT DOCUMENTS

| | | | | |
|---|---|---|---|---|
| DE | 708993 | * | 8/1941 | 70/366 |
| FR | 566170 | * | 11/1923 | 70/366 |
| SU | 592951 | * | 2/1978 | 70/366 |

* cited by examiner

*Primary Examiner*—Lloyd A. Gall
(74) *Attorney, Agent, or Firm*—Bacon & Thomas, PLLC

(57) ABSTRACT

A lock core assembly. The assembly includes an external cylinder, an inner cylinder rotatably fitted in the external cylinder, alignment elements provided in the inner cylinder, at least a limiting element provided in the external cylinder able to engage with the alignment elements, and a key to be inserted into the inner cylinder to move the alignment elements to an unlocking state with the limiting element. When the engaging member is detached, the limiting element is separated from the external cylinder, and then the original coupling of the key and the limiting element are substituted by another coupling of a key and a limiting element, such that, when a user loses his key, he can have the lock core assembly repaired without changing the entire lock set.

2 Claims, 5 Drawing Sheets

LOCK CORE ASSEMBLY

BACKGROUND OF THE INVENTION

1. Field of the Invention

The present invention is related to a lock core assembly, and especially to a lock core assembly by which a user can make repair to substitute another couple of a limiting element and a key for the old couple without changing the entire lock set when the original key get lost, this can reduce expenditure of the user and avoid waste of resources, thus cost of production can be lowered.

2. Description of the Prior Art

Conventional complete set of lock (such as a door lock set) is comprised at least of: a housing, a latch and a lock core assembly, wherein, the latch and the lock core assembly are provided in the housing, while a hole of the lock core assembly is exposed to the outside, when a key is inserted into the hole of the lock core assembly to form an unlocking state, and when the key is rotated to move the latch, the lock is unlocked.

The aforesaid key must match with the lock core assembly for unlocking, if it can not render the lock core assembly to form an unlocking state, the latch will not be moved by the lock core assembly to open the lock. Thereby, in a lock set, a lock core assembly may be considered as the heart of the entire lock set; once the key is lost, the lock core assembly will not be unlocked, and the whole lock set is useless.

When one loses a key for a particular lock, one may call a locksmith to make another key to open the lock. This is not ideal since if the key is found by someone with bad intentions, loss of property may follow. Therefore, in order to avoid such trouble, one generally changes a lock set which is intact and still useful after a key for the lock is lost. However, this is a waste to resources. If it is possible for only the key and the mated lock core assembly to be changed, it is not necessary to have the entire lock set discarded, thus avoiding further waste of resources.

Secondarily, a lock core assembly is comprised of: an external cylinder, an inner cylinder rotatably fitted in the external cylinder, a plurality of alignment elements provided in the inner cylinder, at least a limiting element provided in the external cylinder able to engage with the alignment elements, and a key. When the key is inserted into the inner cylinder to move the alignment elements to their positions making unlocking state with the limiting element, the inner cylinder can be rotated to open the lock.

In other words, the role that the key is to the lock core assembly mainly is to move the alignment elements to the positions to form an unlocking state with the limiting element. Different keys may move the alignment elements to different positions. If the positions after displacement can not be aligned with the limiting element, the lock will not be unlocked. That is, a key and a limiting element making a couple in a lock core assembly mate with each other; and by changing the key and the limiting element in the lock core assembly, another lock core assembly may be formed, and it forms another lock set.

The present invention developed by the inventor of the invention through the thought stated above is characterized by: the limiting element is assembled by means of an engaging member on the external cylinder in coincidence with the specification of the key; when the engaging member is detached, the limiting element can be separated from the external cylinder, then another couple of a key and a limiting element can be substituted for the original couple to form another lock core assembly.

SUMMARY OF THE INVENTION

Therefore, the primary object of the present invention is: a user can make repair to substitute another couple of a limiting element and a key for the old couple without changing the entire lock set when the original key gets lost, this can reduce expenditure of the user and avoid waste of resources.

The secondary object of the present invention is: a manufacturer can manufacture external cylinders, inner cylinders and alignment elements in the mode of mass production with the uniform specifications, then various couples of the limiting elements and the keys mating therewith are assembled with the mentioned members to form different lock core assemblies. In this way, production cost can be largely saved.

The present invention will be apparent after reading the detailed description of the preferred embodiment thereof in reference to the accompanying drawings.

DETAILED DESCRIPTION OF THE PREFERRED EMBODIMENT

Figure 1:
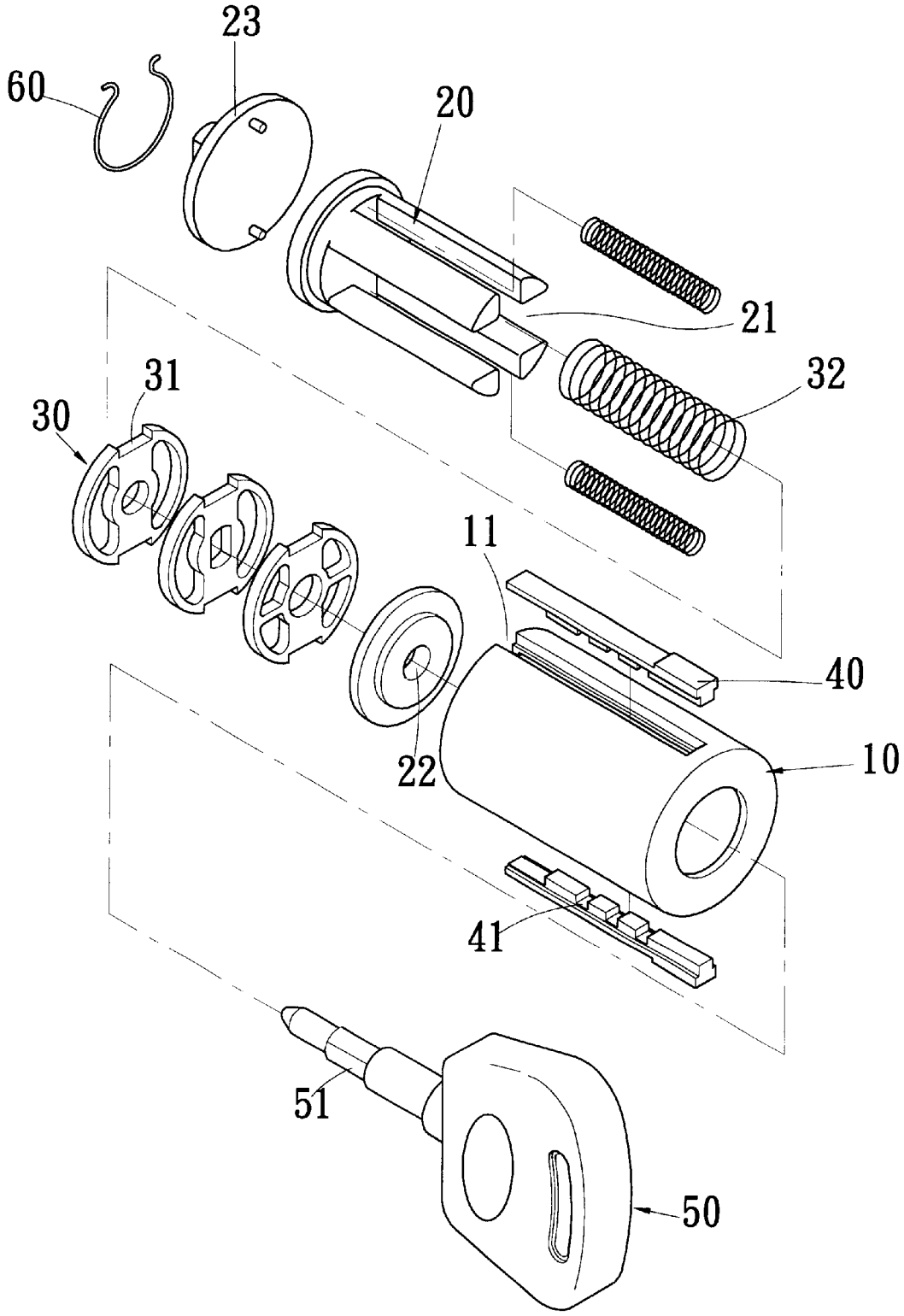
FIG. 1 is an analytic perspective view showing an embodiment of the present invention.
Figure 2:
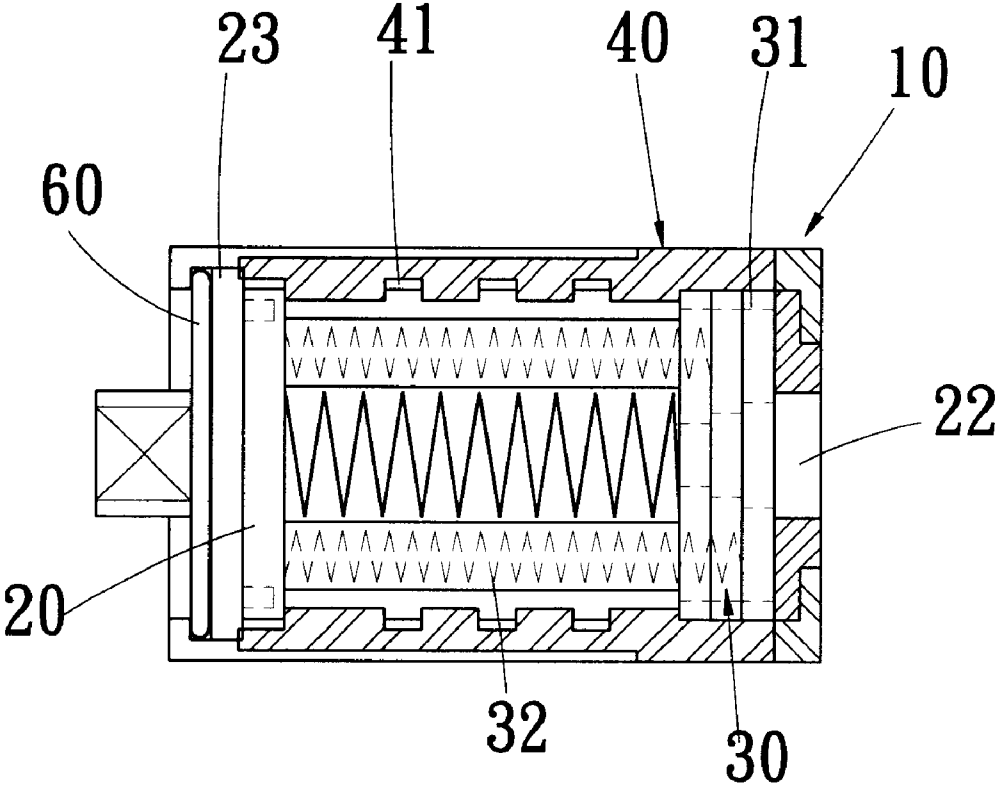
FIG. 2 is a lateral sectional view of the embodiment of the present invention.

Referring to FIGS. 1, 2, the present invention provides a lock core assembly comprised structurally of:

an external cylinder 10 in the shape of a round pipe, it is provided on the external edge thereof at least a slide slot 11 communicating from the external surface to the interior of the external cylinder 10;

an inner cylinder 20 fitted in the external cylinder 10, it is rotatable relative to the external cylinder 10 in an unlocking state. it has a receiving space 21, and is provided with a lock hole 22 on the front end thereof and with a stop piece 23 on the tailing end thereof;

a plurality of alignment elements 30 provided in the receiving space 21 of the inner cylinder 20, they are provided each with a stop portion 31 at the rim thereof all in alignment with the slide slot 11;

at least a limiting element 40 provided on the slide slot 11 in the external cylinder 10, the inner side of the limiting element 40 has a plurality of alignment portions 41 protruding toward the interior of the external cylinder 10 and in the number equal to that of the alignment elements 30; the alignment portions 41 are kept to have their positions alternately arranged with the stop portions 31 of the alignment elements 30, thereby, the alignment elements 30 and the inner cylinder 20 both are unable to rotate relative to the external cylinder 10, and a locking state is obtained.

A key 50 includes a set of teeth or protrusions 51 on a front end thereof. The set of teeth or protrusions 51 can be inserted into a lock hole 22 on the front end of the inner cylinder 20 to move the alignment elements 30 to displace the alignment elements 30 and their stop portions 31.

Figure 3:
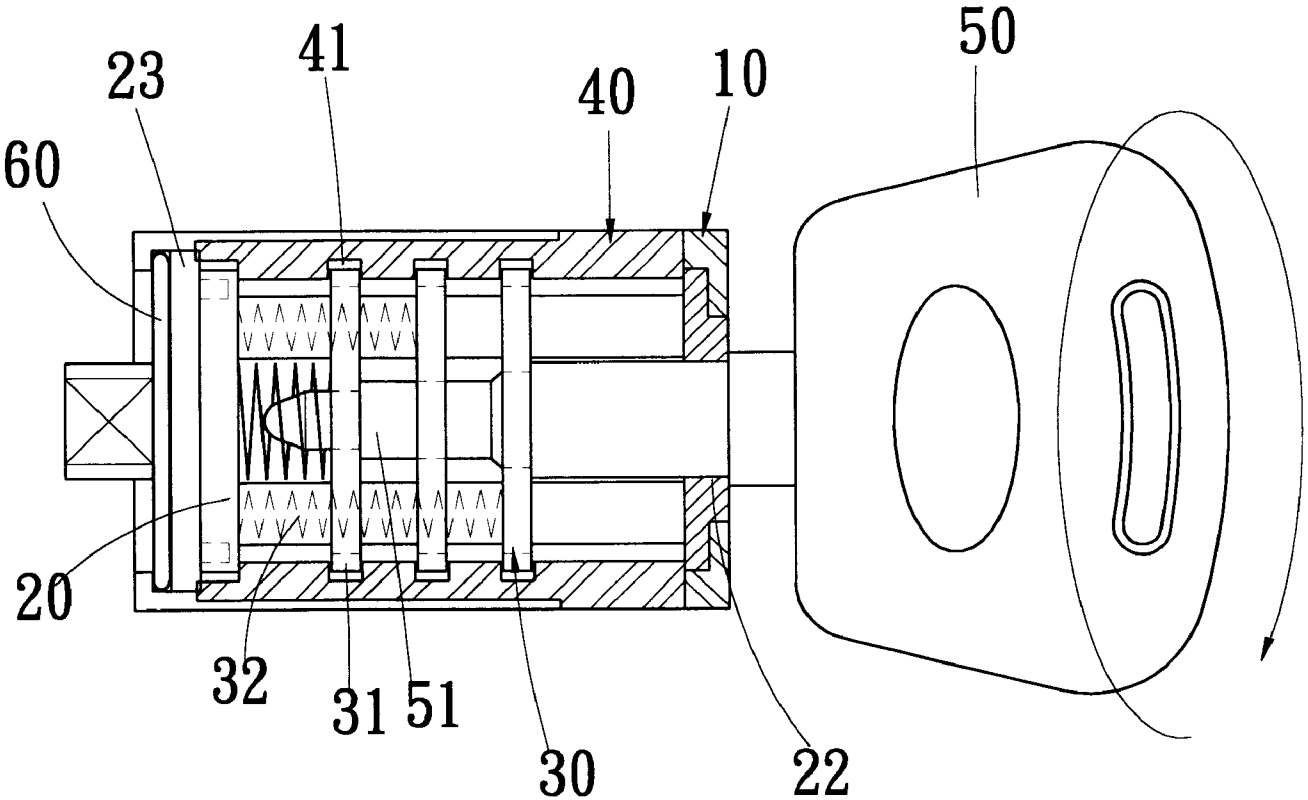
FIG. 3 is a sectional schematic view showing a key is inserted into the embodiment of the present invention to form an unlocking state.

As shown in FIG. 3, when the key 50 with the tooth set 51 on the front end thereof is inserted into a lock hole 22 on the front end of the inner cylinder 20 to displace the alignment elements 30 and their stop portions 31 to be aligned with the alignment portions 41 of the limiting element 40, the stop portions 31 can let pass of the alignment portions 41 to form an unlocking state. At this time, when a force is exerted to rotate the key 50, the inner cylinder 20 and the alignment elements 30 will be moved to rotate relative to the external cylinder 10. In rotation, the stop piece 23 on the tailing end of the inner cylinder 20 simultaneously rotates to open the lock.

Among conventional lock core assemblies, no matter what shapes the alignment elements 30 and the limiting element 40 have, the inner cylinder 20 and the stop piece 23 are retrained from rotation and thereby form a locking state by alternate arrangement of the alignment elements 30 with the alignment portions 41 of the limiting element 40, and the inner cylinder 20 and the stop piece 23 can be rotated to unlock by alignment of the alignment elements 30 with the alignment portions 41 of the limiting element 40. The characteristics of the present invention stated below are applicable to various conventional lock cores.

Figure 4:
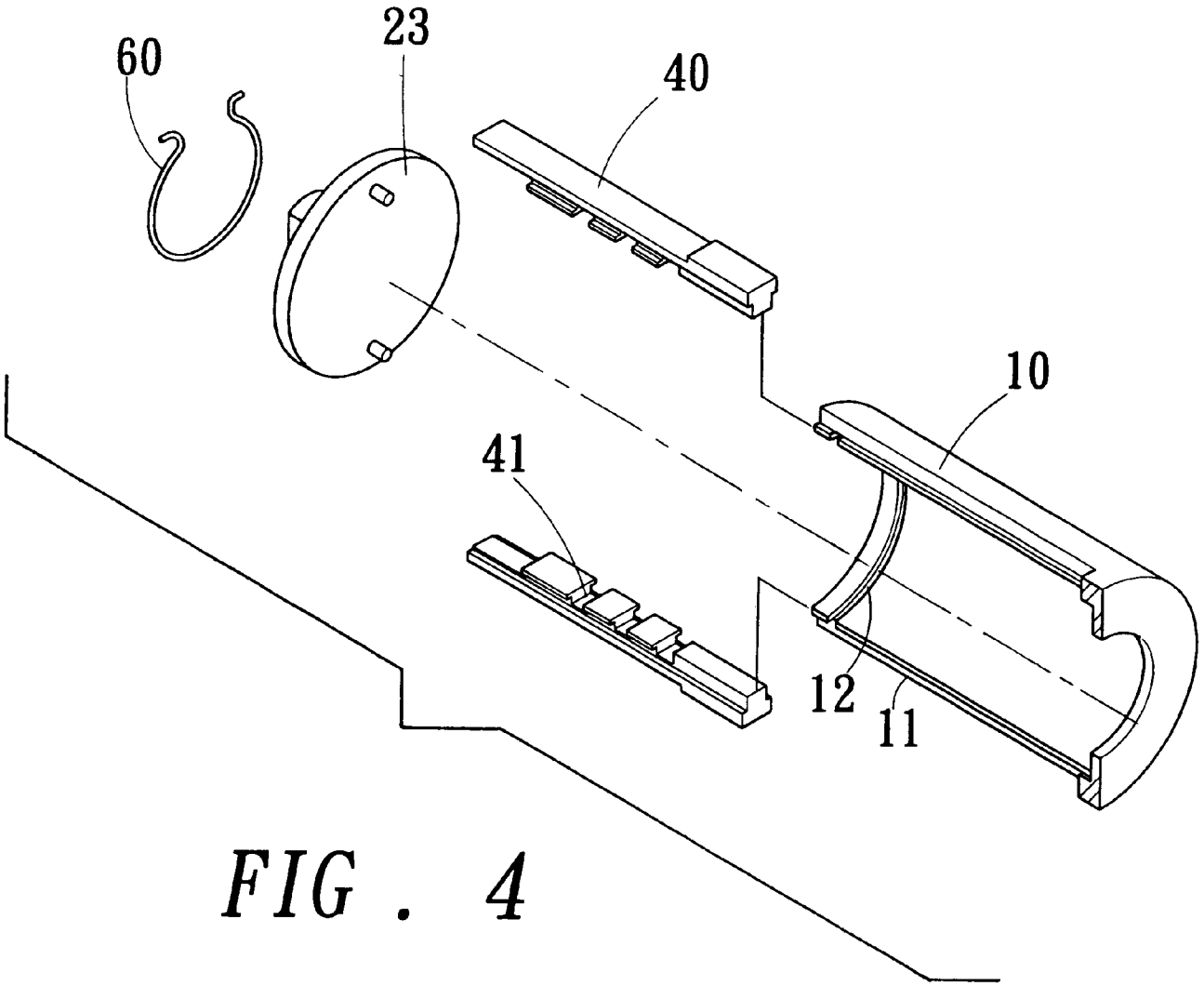
FIG. 4 is an exploded perspective view of a part of the embodiment of the present invention.
Figure 5:
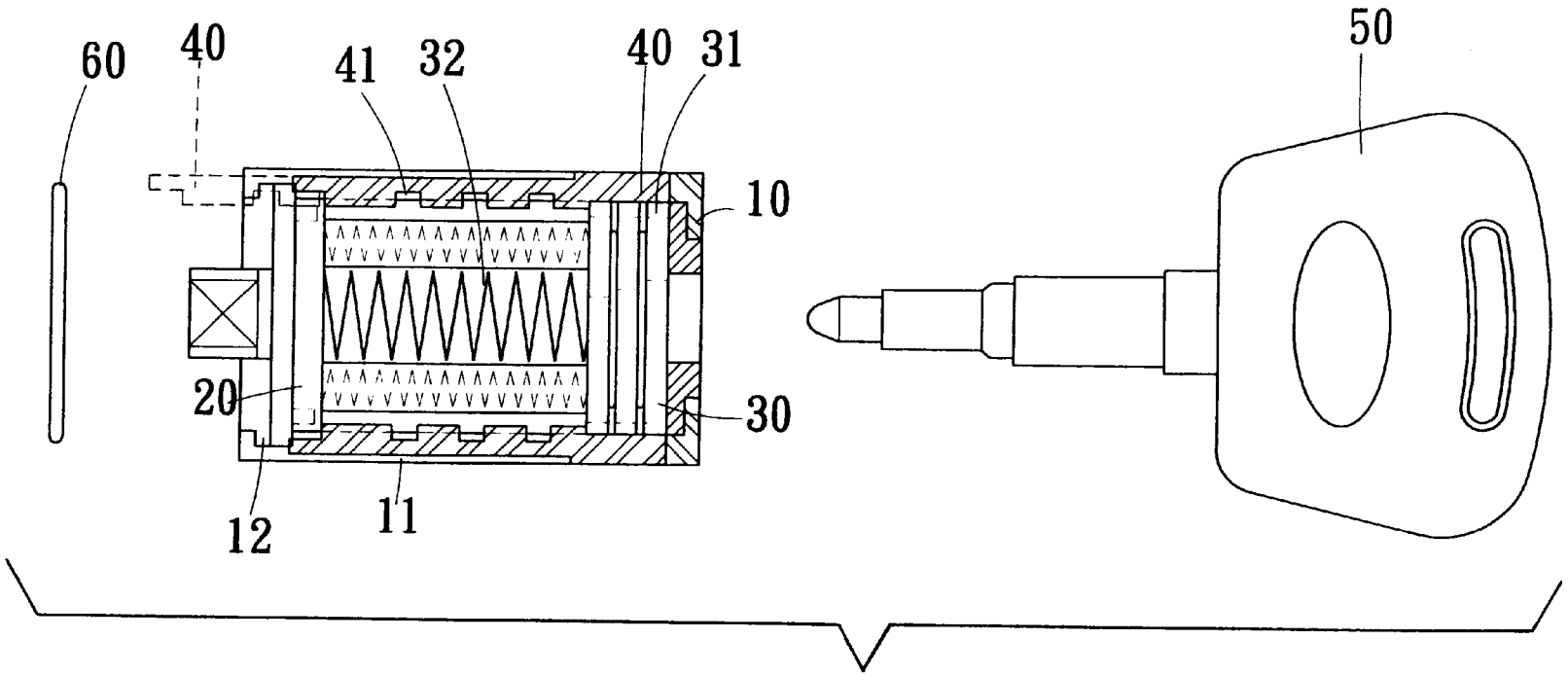
FIG. 5 is a sectional schematic view showing changing of the limiting member of the embodiment of the present invention.

As shown in FIGS. 4 and 5, the present invention is characterized in that, the limiting element 40 mating with the specification of the key 50 is mounted on the external cylinder 10 by means of an engaging member 60. If the engaging member 60 is detached, the limiting element 40 can be separated from the external cylinder 10 for changing for another couple of another limiting element 40 and another key 50. Therefore, when the user loses his key, the user can have the lock core assembly repaired without changing the entire lock set, this can reduce expenditure of the user and avoid waste of resources. And in manufacturing, a manufacturer can manufacture the external cylinder 10, inner cylinder 20 and alignment elements 30 in the mode of mass production with the uniform specifications, then various couples of the limiting elements 40 and keys 50 mating therewith are assembled with the mentioned members to form different lock core assemblies.

In the characteristics of the present invention, the limiting element 40 is an elongate strip able to be inserted into the slide slot 11 of the external cylinder 10, the external cylinders 10 is provided on the tailing end thereof with an annular groove 12 to receive therein the "C" shaped annular engaging member 60. When the limiting element 40 is inserted into the slide slot 11 of the external cylinder 10, engagement of the annular engaging member 60 in the annular groove 12 can restrain the limiting element 40 from drawing out, thus assembling is completed. Relatively, when the annular engaging member 60 is taken out of the annular groove 12, the limiting element 40 can be drawn out of the slide slot 11 for changing for another couple of another limiting element 40 and another key 50.

In the embodiment of the prevent invention, a plurality of alignment elements 30 are each in the shape of a sheet member, their stop portions 31 are notches capable of engaging with the internal surface of the limiting element 40, and are pushed by a spring 32 to abut against the inner front end of the inner cylinder 20 (as shown in FIG. 2). The alignment portions 41 of the limiting element 40 are recessed portions; when the stop portions 31 are alternated with the alignment portions 41, the stop portions 31 are engaged in the limiting element 40 to be restrained from rotations. When the key 50 is inserted (as shown in FIG. 3), the alignment elements 30 are moved rearwardly to align with the alignment portions 41, and restraint to the limiting element 40 is relieved. When the key 50 is drawn out, the alignment elements 30 are moved back to the inner front end of the inner cylinder 20 by the spring 32 and can not be rotated again, thus the locking state is formed again.

The names of the members composing the present invention and the shape shown in the drawings are only for illustrating a preferred embodiment of the present invention, and not for giving any limitation to the scope of the present invention. Various modifications or changes can thus be made to the elements of the present invention without departing from the spirit, scope and characteristic of this invention and also fall within the scope of the appended claims.

What is claimed is:

1. A lock core assembly comprising:

an external cylinder;

an inner cylinder fitted in said external cylinder;

a plurality of alignment elements provided in said inner cylinder;

at least a limiting element provided in said external cylinder able to engage with said alignment elements;

a key which is adapted to be inserted into said inner cylinder to move said alignment elements to positions making unlocking state with said limiting element;

said limiting element is assembled by an engaging member on said external cylinder in coincidence with configuration of said key;

when said engaging member is detached, said limiting element is separated from said external cylinder, then the original couple of said key and said limiting element can be substituted by another couple comprising a new key and a new limiting element to form another lock core assembly; and wherein, said alignment elements are each in the shape of a sheet member, and are provided with stop portions in the form of notches adapted to engage with said limiting element in the form of an elongate strip, and are pushed by a spring to abut against an inner front end of said inner cylinder, alignment portions of said limiting element are recessed portions;

when said stop portions are alternated with said alignment portions, said stop portions are positioned inside said limiting element to be restrained from rotation, and when said key is inserted, said alignment elements are moved rearwardly to align with said alignment portions in the form of recessed portions, then said alignment elements are adapted to pass through said alignment portions, and restraint to said limiting element is relieved; and when said key is drawn out, said alignment elements are moved back to said inner front end of said inner cylinder by said spring and are restrained from rotating to form a locking state.

2. A lock core assembly as claimed in 1, wherein, said external cylinder is provided thereon at least a slide slot and is provided on the tailing end thereof with an annular groove to receive therein a C-shaped annular engaging member; said limiting element is an elongate strip, when said limiting element inserted into said slide slot of said external cylinder, engagement of said annular engaging member in said annular groove restrains said limiting element from drawing out.

* * * * *